US006247935B1

(12) United States Patent
Martin et al.

(10) Patent No.: US 6,247,935 B1
(45) Date of Patent: Jun. 19, 2001

(54) SWIM START TRAINING APPARATUS

(76) Inventors: Charles V. Martin, 12151 Hackamore, Garden Grove, CA (US) 92840; Kerry MacKelvey, 27660 Marguerite Pkwy., Suite 205, Mission Viejo, CA (US) 92692

( * ) Notice: Subject to any disclaimer, the term of this patent is extended or adjusted under 35 U.S.C. 154(b) by 0 days.

(21) Appl. No.: 09/143,287

(22) Filed: Aug. 28, 1998

(51) Int. Cl.[7] ..... A63B 69/14
(52) U.S. Cl. ..... 434/254; 434/247
(58) Field of Search ..... 434/247, 254; 482/15, 16, 19, 55; 472/85, 128

(56) References Cited

U.S. PATENT DOCUMENTS

| | | | | |
|---|---|---|---|---|
| 1,793,898 | * | 2/1931 | Barron | 482/19 |
| 1,808,371 | | 6/1931 | Oertel . | |
| 3,497,212 | * | 2/1970 | Gotcher | 482/17 |
| 3,637,204 | * | 1/1972 | Dawson | 482/8 |
| 3,789,801 | * | 2/1974 | Moreng | 119/705 |
| 3,799,542 | * | 3/1974 | Potgieter | 482/19 |
| 3,809,352 | * | 5/1974 | Kral | 248/444.1 |
| 3,900,194 | * | 8/1975 | Ward | 472/128 |
| 4,134,583 | * | 1/1979 | Davidson | 472/85 |
| 4,223,888 | * | 9/1980 | Greene | 482/17 |
| 4,561,650 | * | 12/1985 | Newton | 482/19 |
| 4,598,906 | * | 7/1986 | Sansbury | 482/17 |
| 4,666,147 | * | 5/1987 | Warman | 482/30 |
| 4,754,965 | * | 7/1988 | Moye | 482/19 |
| 4,778,174 | * | 10/1988 | Tolsma | 482/15 |
| 4,913,420 | * | 4/1990 | Moye | 482/19 |
| 5,005,828 | * | 4/1991 | Sauerbrey | 482/17 |
| 5,033,737 | * | 7/1991 | Moye | 482/17 |
| 5,334,119 | * | 8/1994 | Eloranta | 482/16 |
| 5,334,121 | * | 8/1994 | McPhilomy | 482/17 |
| 5,586,520 | * | 12/1996 | Cleary | 119/705 |
| 5,842,954 | * | 12/1998 | Slupskiy | 482/15 |

* cited by examiner

*Primary Examiner*—Jacob K. Ackun, Jr.
*Assistant Examiner*—K. Fernstrom
(74) *Attorney, Agent, or Firm*—Stout, Uxa, Buyan & Mullins, LLP; Frank J. Uxa

(57) ABSTRACT

Apparatus for training a race swimmer to start a race include a first support assembly and a first hurdle member adapted to be held by the first support assembly above the water in a swimming pool, to be removed from the first support assembly by the force of a swimmer impacting the first hurdle member and to, thereafter, be positioned to be held by the first support assembly. The present apparatus preferably are portable and very flexible so as to provide a very effective training apparatus for swimmers. In addition, a starting block apparatus includes a portable base member, an adjustment assembly and a platform member which is adapted to be adjusted to vary the height of the platform member above the deck of a swimming pool and/or the angle of the platform assembly relative to the deck, as desired.

20 Claims, 4 Drawing Sheets

10
12
14
16
18
20
21
22
24
26
28
30
31
32
33
34
35
35A
37
37A
39
40
41
42
43
43A
44
45
46
47
48
49
50
51
52
53
54
55
56
59
60
62
64
66
68
69
70
73
76
114

FIG. 2
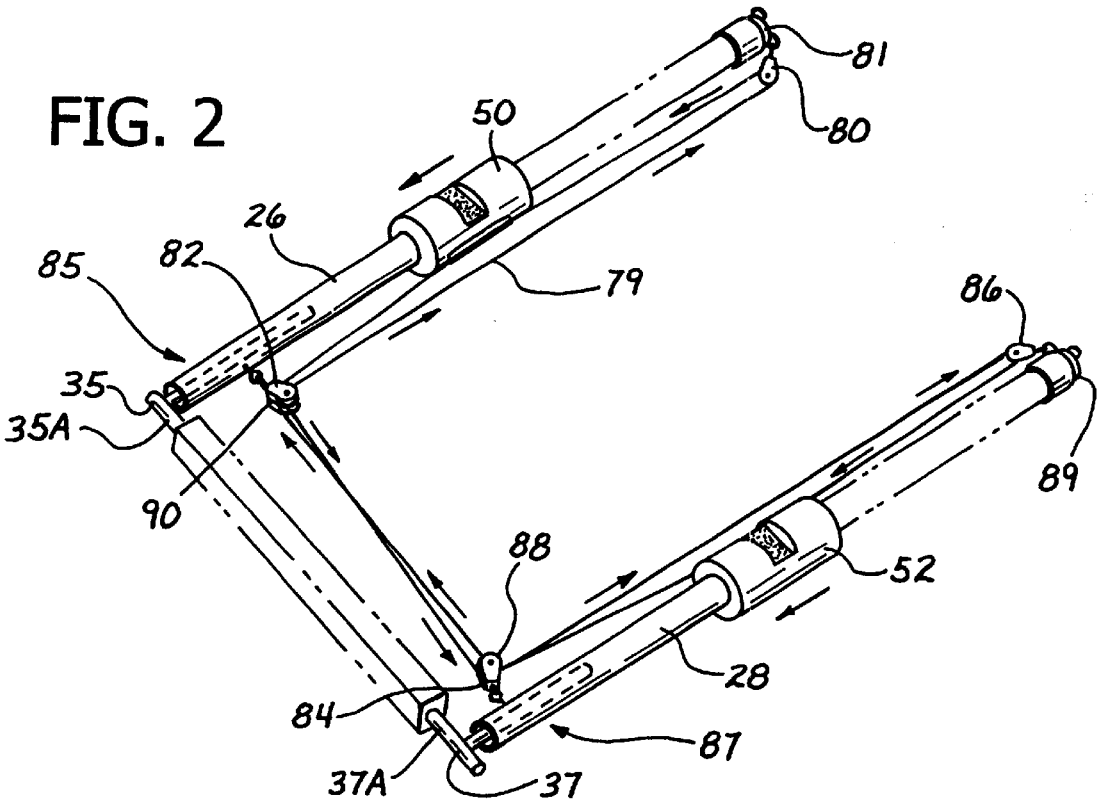
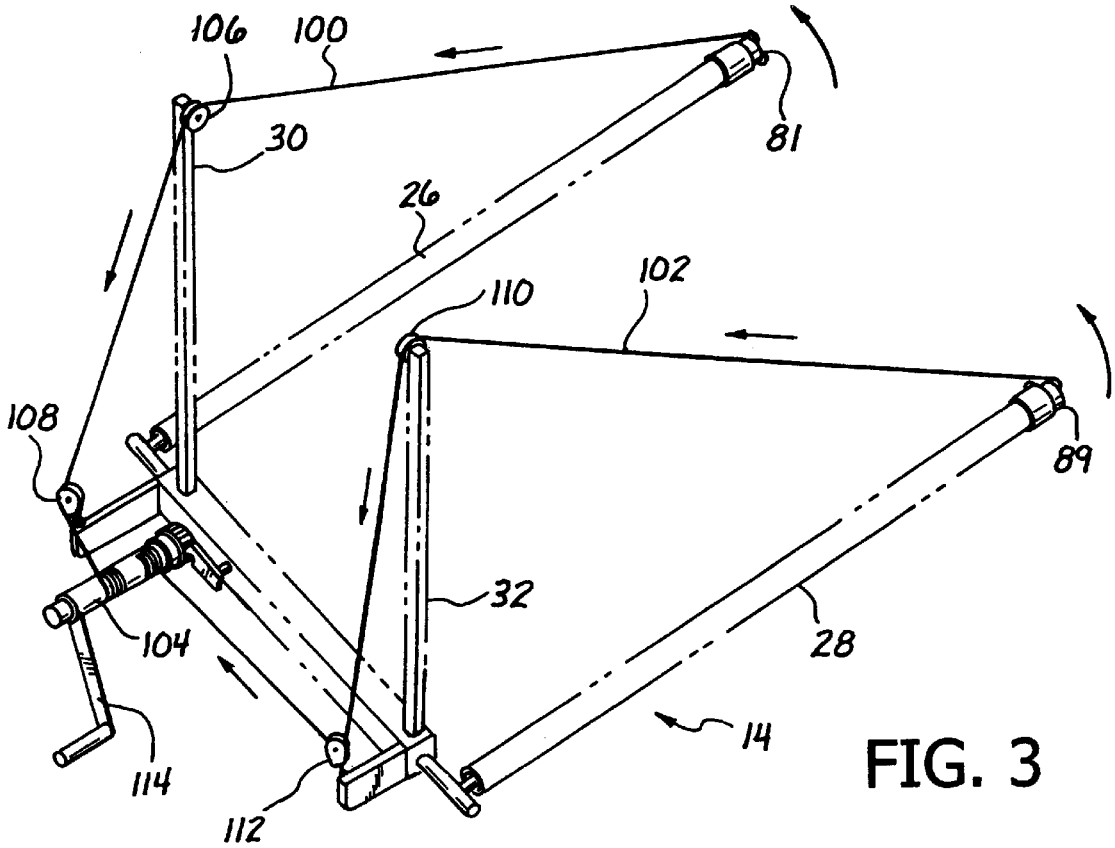
FIG. 3

SWIM START TRAINING APPARATUS

BACKGROUND OF THE INVENTION

The present invention relates to apparatus useful for training race swimmers. More particularly, the invention relates to apparatus useful for training race swimmers to start a race effectively, for example, so as to reduce the overall time needed to complete the race.

Competitive swimming races are conventionally started with the race swimmers positioned on or holding to a stationary starting block affixed to the deck of a swimming pool. The swimmers themselves are also stationary at the start of the race.

One of the important parts of a swim race is the start. Thus, the swimmer should leave the block as effectively as possible in order to reduce, or even minimize, the time needed to complete the entire race. Although swim training includes teaching the swimmer how to start, most of this training focuses in on the position of the swimmer relative to the block, and the position of the swimmer as he/she enters the water.

Little or no attention has been paid to the height and/or length of the dive into the water as part of the start technique. For example, one approach to swim starting is to dive off the block and get into the water as soon as possible. While this approach does cause one to begin actually swimming quickly, it is not necessarily the most effective starting approach.

It would be advantageous to provide an apparatus to train swimmers in effective starting of swim races.

SUMMARY OF THE INVENTION

Apparatus useful for training a race swimmer to start a race have been discovered. The present apparatus are relatively straightforward and very effectively train a race swimmer to start a race so as to reduce, or even minimize, the overall time required to complete the race. The present apparatus effectively allow the swimmer to determine whether his/her starting technique is satisfactory. In addition, the apparatus are very easy to use so that the swimmer can practice his/her starting technique many times within a short period of time. Also, the apparatus preferably are easily and rapidly reconfigured or adjusted to accommodate swimmers of different physical stature and/or abilities. Overall, the present apparatus provides effective swim start training while, at the same time, being fun to use.

In one broad aspect of the present invention, apparatus for training a race swimmer to start a race in a swimming pool containing water comprise a first support assembly and a first hurdle member adapted to be held by the first support assembly above the water in the swimming pool, to be removed from the first support assembly by the force of a swimmer impacting the first hurdle member and to be positioned, or repositioned, to be held by the first support assembly. Using a hurdle member adapted to be removed from the support assembly by the force of a swimmer impacting the hurdle member allows the swimmer to know very promptly whether the practice start had sufficient height or sufficient distance to clear the hurdle member. Also, since the hurdle member is adapted to be repositioned so as to again be held by the support assembly, the present apparatus can be very effectively and quickly placed in a condition ready for reuse by the same swimmer or another swimmer. Thus, the combination of the hurdle member being adapted to be removed from the support assembly in response to swimmer impact and the hurdle adapted to be placed back onto the support assembly quickly and easily provides substantial benefits which enhance the usefulness and effectiveness of the present apparatus.

In one very useful embodiment of the present invention, the apparatus further comprises a second support assembly and a second hurdle member adapted to be held by the second support assembly, for example, in a manner similar to the first hurdle member being held by the first support assembly. The second hurdle member preferably is adapted to be removed from the second support assembly by the force of a swimmer impacting the second hurdle member and to be positioned, or repositioned, to be held by the second support assembly. The second hurdle member preferably is adapted to be held by the second support assembly at an elevation above the water in a swimming pool. The first hurdle member preferably is located at an elevation higher than the second hurdle member.

In one embodiment, the second hurdle member is positioned relative to the first hurdle member to extend further away from a swimmer ready to use the apparatus. Thus, the first hurdle member may be considered a height hurdle and the second hurdle member may be considered to be a distance or angle of entry hurdle. In other words, the first hurdle member is positioned to allow the swimmer using the apparatus to reach a certain height in his/her dive into the pool; while the second hurdle member is positioned to allow the swimmer to control the distance of his/her dive into the pool and/or the angle of entry into the pool.

It has been found that, all other factors being equal, the combination of a relatively high dive together with a relatively long dive and/or a dive allowing the swimmer to achieve a suitable angle of entry into the water in the pool provides enhanced benefits to the swimmer, in particular reduced race times. Among the other factors which are to be considered in the performance of a race swimmer include, but are not limited to, positioning on the starting block and on entering the water, swimming ability in the water, breathing techniques, turning techniques, finishing techniques and the like.

In one useful embodiment, the first support assembly is adjustable to hold the first hurdle member at any one of a plurality of different positions, more preferably over a substantially continuous range of different positions. The second support assembly preferably is adjustable to hold the second hurdle member at any one of a plurality of different positions, more preferably over a substantially continuous range of different positions.

The first support assembly preferably is adjustable to extend away from a swimmer ready to use the apparatus at any one of a plurality of different angles relative to the water in the swimming pool or to the swimming pool deck. The second support assembly preferably is adjustable to extend away from a swimmer ready to use the apparatus at any one of a plurality of different angles relative to the water in the swimming pool or to the swimming pool deck.

The substantial degree of adjustability of the present apparatus, as set forth herein, allows the apparatus to be quickly and specifically adapted to a wide range of different swimmers, for example, of different physical stature and/or different ability levels.

Although the support assemblies useful in the present apparatus may be chosen from any suitable components, in one useful embodiment, the support assemblies, that is either one or both of the first and second support assemblies, each includes two spaced apart elongate rods and two sleeves.

Each of the sleeves is located on a different one of the elongate rods making up the support assembly. Each of the sleeves is adapted to hold a portion of a hurdle member. More preferably, each of the sleeves is adjustable to be located at any one of a plurality of positions along the length of the rod on which the sleeve is located, for example, over a substantially continuous range of different positions.

In a very useful embodiment, the first and/or second support assembly preferably further includes a sleeve adjustment assembly positioned so that both of the sleeves are attached thereto and are adapted to be moved, for example, manually moved, so that each of the sleeves is located, at any given time, at substantially the same relative position along the length of the rod on which the sleeve is located.

To reiterate, the above description with regard to the elongate rods and sleeves refers to the first support assembly and/or the second support assembly. Thus, the first support assembly preferably includes first elongate rods, first sleeves and a first sleeve adjustment assembly. Similarly, the second support assembly preferably includes second elongate rods, second sleeves and a second sleeve adjustment assembly.

Each of the sleeves preferably includes a groove, sized and adapted to receive a portion of the hurdle member. Each of these grooves more preferably includes a hook portion or a loop portion of a hook/loop fastener combination, e.g., a VELCRO fastener, and each of the portions of the hurdle member received in the groove includes the other of the loop portion or the hook portion of the hook/loop fastener combination. Using this feature provides a degree of resistance to the hurdle member being removed from the support assembly. Thus, the swimmer can come into slight contact with or lightly brush the hurdle member without removing or dislodging the hurdle member from the support assembly.

The grooves can be included in one or both of the first sleeves or second sleeves.

The hurdle members may be of any suitable construction provided that they are adaptable for the purposes contemplated and are sufficiently durable to be repeatedly removed from and repositioned on the support assembly. In addition, the hurdle member or members should be constructed so as not to injure a swimmer who impacts the hurdle member.

In one particularly useful embodiment, the first and/or second hurdle member includes two rigid, spaced apart end segments each coupled to a soft, middle segment. For example, the end segments may be produced from tubular or pipe segments, for example, of polyvinylchloride (PVC), while the middle segment may be made of foam rubber, for example, in the form of a tube such as the tubes sold under the trademark WATER NOODLE by FUNNOODLE.

In using the preferred construction noted above, the hurdle member further includes two enlarging element, for example, portions of hook/loop fastener combinations, positioned on each of the end segments to facilitate coupling or securing the end segments to the middle segment of the hurdle member.

The apparatus preferably further comprises a portable block assembly including a starting platform, more preferably an adjustable starting platform, on which the swimmer, ready to use the apparatus, starts. Providing for a portable block assembly is very useful in making the entire apparatus portable. Thus, the apparatus preferably is sufficiently portable so that it can be transported from swimming pool to swimming pool to provide training sessions for a large number of swimmers. The adjustability of the starting platform is particularly beneficial in that each pool has a different configuration which may require that the starting platform be adjusted, for example, to a given height above the water and/or a given angle relative to the level of the pool deck, in order to obtain more useful results with the present apparatus.

In another aspect of the present invention, a starting block apparatus is provided which includes a portable base member, an adjustment assembly and a platform member. This starting block apparatus may be used separately or in conjunction with the other apparatus described herein.

The portable base member is adapted to be placed on, but preferably not affixed or secured to, an area of a deck surrounding a swimming pool. The base member preferably is further adapted to be ballasted, for example, by a volume or weight of water or the like liquid, so as to remain substantially stationary and stable on the area of the deck when a swimmer uses the apparatus.

The adjustment assembly is coupled to the base member. The platform member is coupled to the adjustment assembly and is sized and adapted to carry the weight of a swimmer using the apparatus. The adjustment assembly is effective to vary one or both of the height of the platform member above the area of the deck and the angle of the platform member relative to the deck or to the water in the swimming pool, as desired.

Combinations of any two or more features described herein are included within the scope of the present invention, provided that such features are not mutually inconsistent.

These and other aspects of the present invention are apparent in the following description and claims, particularly when considered in conjunction with the accompanying drawings in which like parts bear like reference numerals.

BRIEF DESCRIPTION OF THE DRAWINGS

FIG. 2 is a top side view, in perspective, of a portion of the second support assembly included in the apparatus shown in FIG. 1.

FIG. 3 is a top side view, in perspective, of another portion of the second support assembly included in the apparatus shown in FIG. 1.

DETAILED DESCRIPTION OF THE DRAWINGS

Figures 1, 1A:
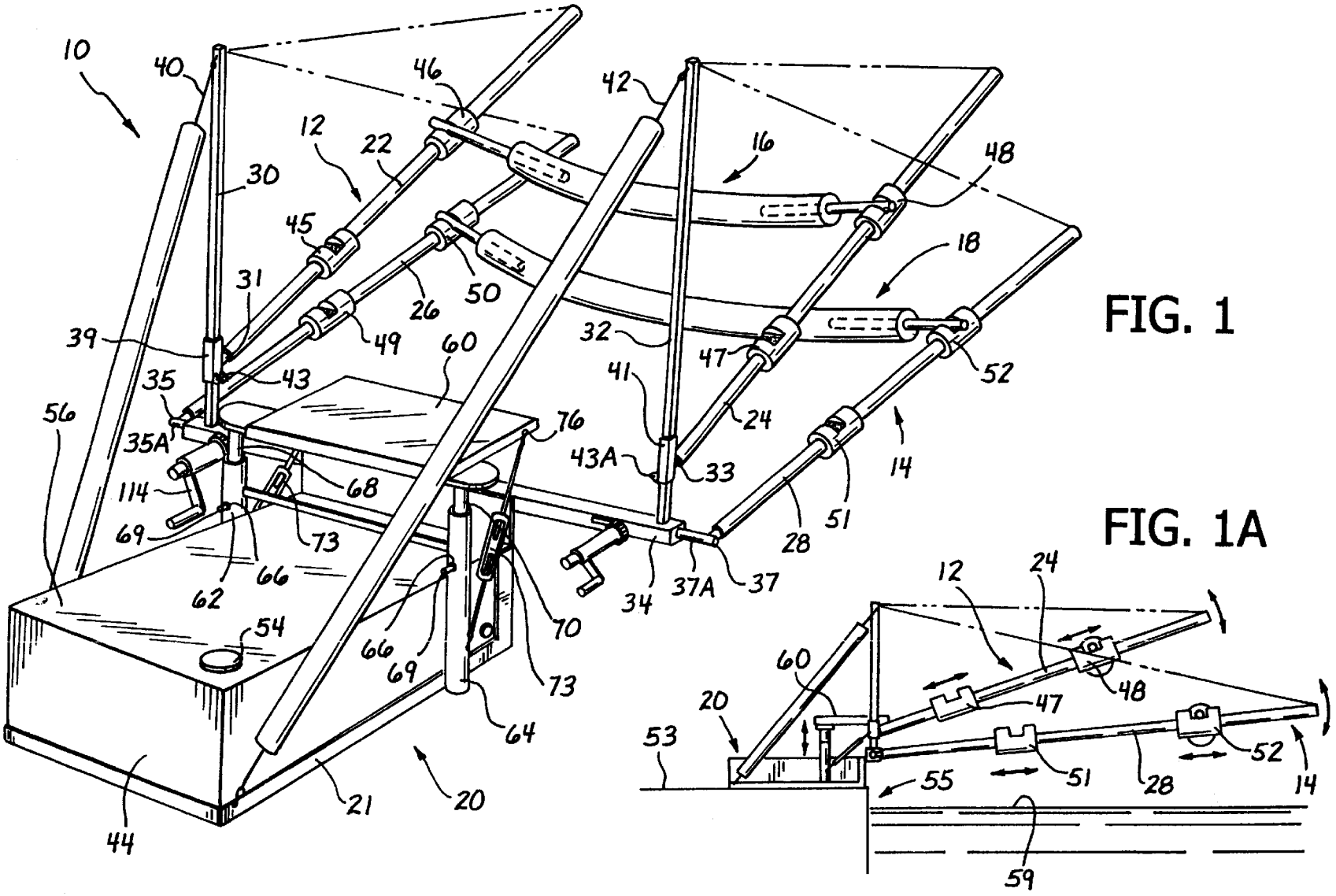
FIG. 1 is a back side view, in perspective, of a swim start training apparatus in accordance with the present invention.
FIG. 1A is a side view of the apparatus shown in FIG. 1 illustrating the adjustability of the apparatus.

Referring now to the drawings, the swim start training apparatus of the present invention, shown generally at 10, includes a first support assembly 12, a second support assembly 14, a first hurdle member 16, and a second hurdle member 18. A starting block assembly 20 is also included.

First support assembly 12 includes two first elongate rods 22 and 24 which extend outwardly from the starting block assembly 20 on either side thereof. Similarly, second support assembly 14 includes two second elongate rods 26 and 28 which extend outwardly from either side of starting block assembly 20. First elongate rods 22 and 24 are removably joined to and pivotable relative to supports 30 and 32, respectively. Each of these supports 30 and 32 has an adjustable height and is secured to bar element 34. Second elongate rods 26 and 28 are removably joined to extensions 35 and 37, respectively, of bar element 34.

In more detail, first elongate rods 22 and 24, for example, made of hollow PVC tubing, slip over extensions 31 and 33, respectively of supports 30 and 32, respectively. Each of the supports 30 and 32 is square or rectangular in cross-section and includes a height adjustment collar 39 and 41, respectively, to which extensions 31 and 33 are pivotably secured. The height adjustment collars 39 and 41 are movable along the length of supports 30 and 32, respectively, and can be secured in place at any point along the length of the supports using conventional bolt clamps 43 and 43A, respectively. In this manner, the height of the first elongate rods 22 and 24 relative to bar element 34 can be adjusted, as desired.

Second elongate rods 26 and 28, for example, made of hollow PVC tubing, slip over "L"-shaped extensions 35 and 37, respectively, as shown in FIG. 2. Since the legs 35A and 37A, of "L"-shaped extensions 35 and 37, respectively, are secured to and rotate relative to bar element 34, second elongate rods 26 and 28 are pivotably movable about the bar element 34.

Figure 7:
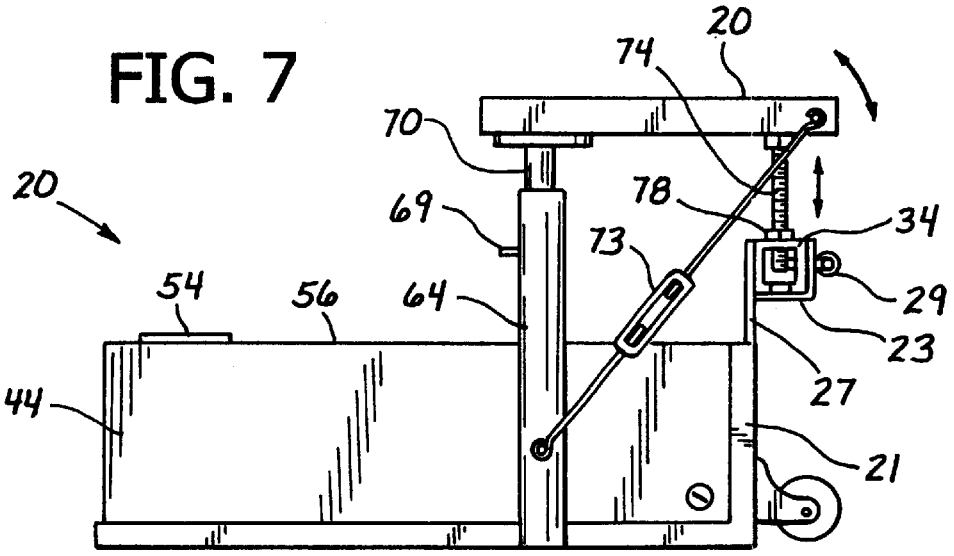
FIG. 7 is a side plan view showing the starting block assembly included in the apparatus shown in FIG. 1.

Bar element 34 is secured to starting block assembly 20. In particular, starting block assembly includes a frame 21, for example, made of metal, which extends around the bottom edge of tank or container 44 and extends upwardly on the front of the container (FIG. 7). With reference to FIG. 7, two spaced apart brackets 23 (only one shown) extend forwardly from top portion 27 of frame 21. Brackets 23 are sized and positioned so as to hold bar element 34. Bolts 29 (only one shown) pass through holes in brackets 23, bar element 34 and top portion 27 to secure the bar element to the starting block assembly 20.

A system of pulleys and cords or ropes associated with supports 30 and 32 act to support the elongate rods 22, 24, 26 and 28. In addition, supports 30 and 32 are secured or maintained in place by attachment to stability cords 40 and 42, respectively, which are both secured to the frame 21 of starting block assembly 20.

First support assembly 12 includes two first sleeves 46 and 48. Similarly, second support assembly 14 includes two second sleeves 50 and 52. As will be discussed in detail hereinafter, first hurdle member 16 is held in place by first sleeves 46 and 48 while second hurdle member 18 is held in place by second sleeves 50 and 52. Optionally, first support assembly can include two additional first sleeves 45 and 47, and second support assembly 14 can include two additional second sleeves 49 and 51.

As shown in FIG. 1A, first support assembly 12 can be adjusted to move first elongate rods 22 (not shown) and 24 up and down so as to be at any one of a plurality of different angles relative to starting block assembly 20. Similarly, second support assembly 14 can be adjusted to move second elongate rods 26 (not shown) and 28 up and down to be oriented at any one of a plurality of different angles relative to the starting block assembly 20. Also, the first sleeves 45 and 46 (not shown) and 47 and 48 and the second sleeves 49 and 50 (not shown) and 51 and 52 can be adjusted so as to be located at any one of a plurality of different positions along the length of the first elongate rods 22 and 24 and the second elongate rods 26 and 28, respectively. These adjustments are described in more detail hereinafter.

Referring to FIGS. 1, 1A and 7, starting block assembly 20 includes tank 44 which forms a hollow container. Cap 54 is located and covers an opening in top 56 of tank 44. With tank 44 empty, the apparatus 10, including starting block assembly 20, is moved on the pool deck 53 to the edge of the swimming pool, as best shown in FIG. 1A. Starting block assembly 20 can be used by a swimmer without the other components of apparatus 10. Before a swimmer uses the apparatus 10 or starting block assembly 20, the cap 54 is removed and a quantity of water is placed in tank 44 to provide ballast to starting block assembly 20. After the tank 44 is filled sufficiently, the cap 54 is used to cover the opening in the top 56 of base 44. At this point, although the starting block assembly 20 is not permanently secured to or affixed to the deck 53 of the swimming pool 55, it is maintained stationary even when a swimmer uses the apparatus 10 or starting block assembly 20 alone.

Starting block assembly 20 includes a starting platform 60 on which a swimmer using the starting block assembly is positioned. Starting platform 60 is adjustable both as to height and angle relative to the water 59 in the swimming pool 55. Thus, two pipes 62 and 64 secured on either side of frame 21 extend upwardly on either side of platform 60 and are provided with a hole 66. Platform 60 is supported by two support pipes 68 and 70 which extend into the pipes 62 and 64, respectively. Each of these support pipes 68 and 70 includes a series of longitudinally spaced apart holes (not shown) so that adjustment pins 69 can be placed through the hole 66 in each of pipes 62 and 64 and through one of the holes in each of support pipes 68 and 70 to maintain the platform 60 at a desired height above water 59. By selecting the holes in support pipes 68 and 70 through which the adjustment pins 69 are placed, one can adjust and control the height of starting platform 60, as desired.

With regard to the adjustment of the angle of the platform 60, two turnbuckles 73, secured to the bottom of platform 60 and to the pipes 62 and 64, are employed. By appropriately turning the turnbuckles 73, the angle of platform 60 can be adjusted, as desired. Two threaded rods 74 (only one shown in FIG. 7) are provided and extend downwardly from the bottom 76 of platform 60. Threaded rods 74 extend into nuts 78 supported on frame 21. The combination of the threaded rods 74 and nuts 78 assist in stabilizing the platform 60 after the angle of the platform has been adjusted using turnbuckles 73.

FIG. 2 illustrates the structure used to adjust the positions of second sleeves 50 and 52. The positions of first sleeves 46 and 48 (as well as the positions of the optional sleeves 45, 47, 49 and 51), are adjustable in a substantially similar manner.

Figure 4:
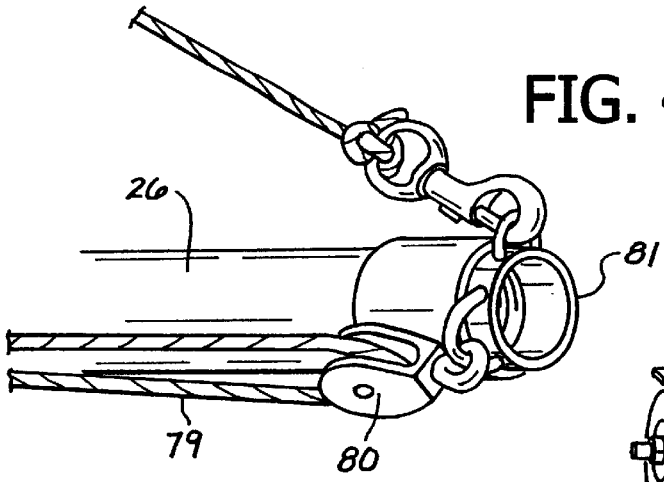
FIG. 4 is a partial side view, in perspective, of a support included in the apparatus shown in FIG. 1.
Figure 8:
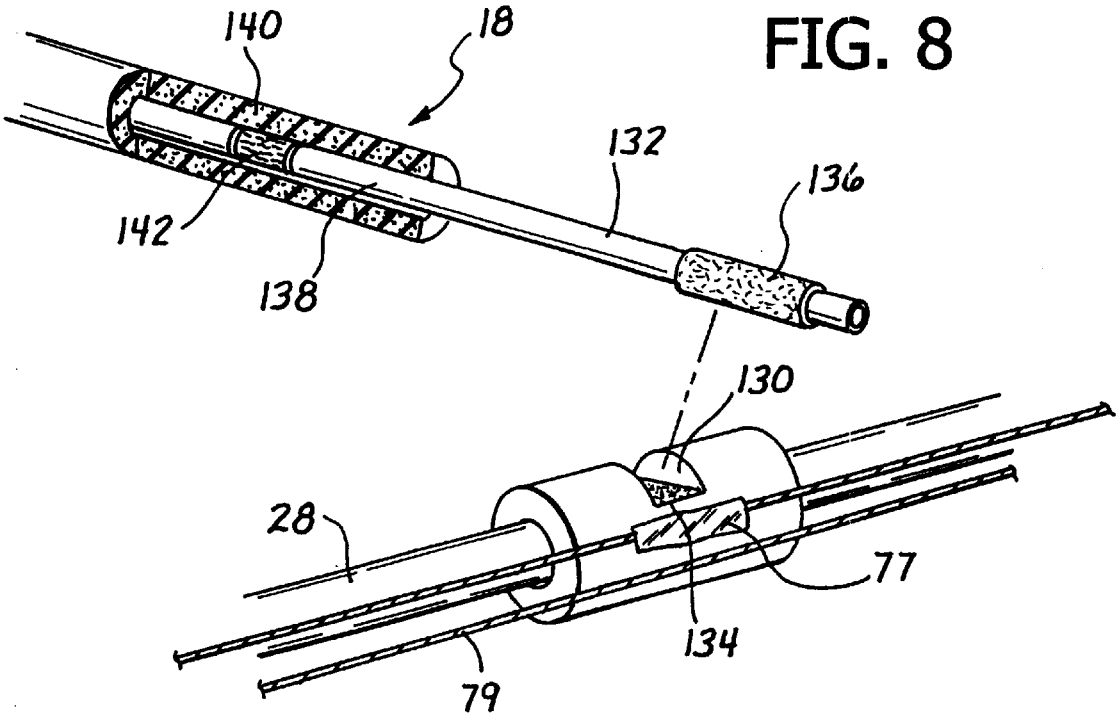
FIG. 8 is a blown-apart partial view, in perspective, showing the second hurdle member and a second sleeve included in the apparatus shown in FIG. 1.

With reference to FIG. 2, second sleeve 50 is located on and surrounds second elongate rod 26 while second sleeve 52 is located on and surrounds second elongate rod 28. In addition, an endless cord 79 is secured to both second sleeves 50 and 52, for example, using a bolted chip covered by a piece of tape 77, as shown in FIG. 8. Cord 79 passes around pulley 80 located at and secured to the forward end 81 of second elongate rod 26 (see FIG. 4) and passes back to the second sleeve 50 to which it is attached. The cord 79 then is directed around pulley 82, which is secured to rear end 85 of second elongate rod 26 (FIG. 6), and crosses over to pulley 84 secured to rear end 87 of second elongate rod 28. The cord 79 then extends outwardly to pulley 86 located at the forward end 89 of second elongate rod 28. Cord 79 then returns back along the length of second elongate rod 28 and is attached to second sleeve 52. The cord 79 then passes around pulley 88 secured to rear end 87, crosses over and is passed around pulley 90 and then proceeds to pulley 80 at the forward end 81 of second elongate rod 26.

The manner in which cord 79 is positioned relative to the various pulleys described, and in particular with regard to the above-noted crossovers, allows for manual movement of any portion of the cord 79 to result in both second sleeves 50 and 52 being moved in the same direction so that the sleeves are located at approximately the same point relative to the length of second elongate rods 26 and 28, respectively. (Of course, the second sleeves 50 and 52 are initially positioned at the same point along the length of rods 26 and 28, respectively.) The adjustment of the position of second sleeves 50 and 52 in this manner allows for a substantially continuous adjustment so that swimmers of differing physical stature or swimming abilities can be trained using the same apparatus 10.

Referring to FIG. 3, the angle of the second elongate rods 26 and 28 relative to the water in the swimming pool is adjustable as follows. The angle of first elongate rods 22 and 24 relative to the water in the swimming pool is adjustable in a substantially similar manner.

Two separate cords 100 and 102 are wound together on spool 104. One end of cord 100 is secured to the forward end 81 of second elongate rod 26 (see FIG. 4). The cord 100 then is passed around pulley 106, located on support 30 (see FIG. 5), and pulley 108 prior to being secured to spool 104. Similarly, cord 102 is secured to the forward end 89 of second elongate rod 28 and is passed around pulley 110, located on support 32, and pulley 112 before being secured to spool 104.

By turning hand crank 114, spool 104 is rotated causing cords 100 and 102 to be either accumulated on the spool or to be released from the spool. In this manner, the angle of each of second elongate rods 26 and 28 relative to the water in the swimming pool is adjusted, to the same extent, based on the amount of cord 100 and 102, respectively, on the spool 104.

Figure 5:
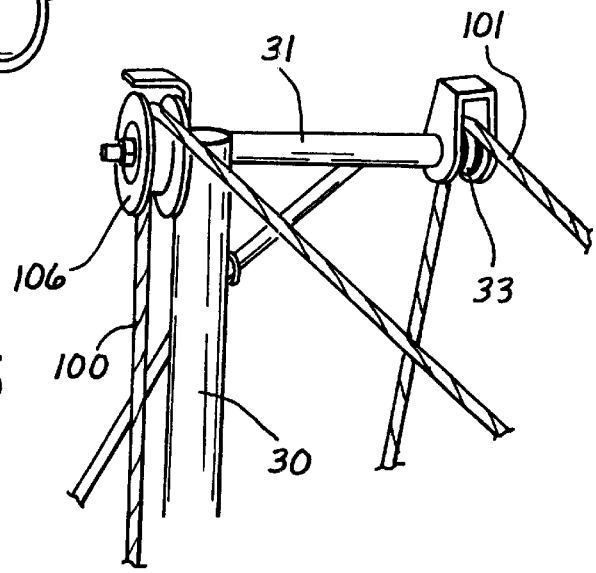
FIG. 5 is a front view, in perspective, of a portion of the support structure included in the apparatus shown in FIG. 1.

FIG. 5 illustrates how support 30 (and similarly support 32) is used to support both first elongate rod 12 and second elongate rod 26. A cross bar 31 is secured to support 30 and carries pulley 33. Pulley 33 is used to route cord 101 which is attached to first elongate rod 12 in a substantially similar manner to how cord 100 is attached to second elongate rod 26, described herein.

Figure 6:
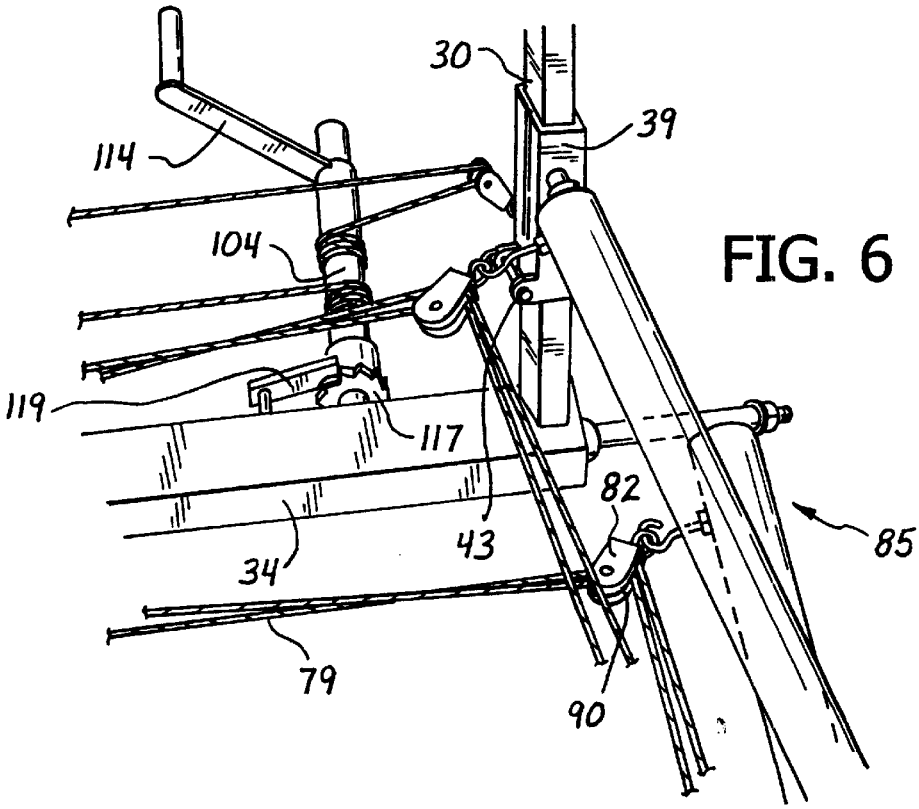
FIG. 6 is a front view, in perspective, showing a hand crank and other components employed in adjusting the apparatus shown in FIG. 1.

As shown in FIG. 6, a gear member 117 surrounds and is secured to spool 104. A gear stop 119 is secured to bar element 34 and is movable so as to contact gear member 117 to maintain the gear member in position, thereby maintaining the spool 104 stationary. The stop 119 can be manually moved out of contact with gear member 117 so that spool 104 can be turned to adjust the angular orientation or position of second elongate rods 26 and 28 and second support assembly 14, as desired.

Referring now to FIG. 8, second elongate rod 28 is shown with second sleeve 52 located on and surrounding the rod. The second sleeve 52 includes a groove 130 which is sized and adapted to receive end portion 132 of second hurdle 18. The bottom of groove 130 includes the loop portion 134 of a VELCRO fastener, which is glued or otherwise affixed to the bottom of the groove. The end segment 132, for example, a section of PVC pipe, includes the hook portion 136 of a VELCRO fastener. The hook portion 136 is preferably glued or otherwise affixed to end segment 132. When the end segment 132 is placed in groove 130 of second sleeve 52, the hook portion 136 engages the loop portion 134 so as to provide a significant degree of resistance against the end segment 132 leaving groove 130. The end portion 138 of end segment 132 extends into (but not all the way to the center of) the middle portion 140 of second hurdle member 18. The middle portion 140 is of foam rubber construction and, for example, is a WATER NOODLE which is well known and commercially available. A hook or loop portion 142 of a VELCRO fastener is adhered to the end 138 of end segment 132. This hook or loop portion 142 acts to provide a snug fit between the end segment 132 and the middle portion 140. In addition, the hook or loop portion 142 may engage the middle portion 140 and provide additional resistance to the end segment 132 separating from the middle portion.

Each of the first and second sleeves 45, 46, 47, 48, 49, 50 and 51 is constructed similar to that shown with regard to second sleeve 52. In addition, both the first hurdle member 16 and second hurdle member 18 are constructed as shown in FIG. 8 with a substantially similar end segment located on the opposite end of middle portion 140.

The first and second hurdle members 16 and 18 are constructed so as to be positioned on the first and second support assemblies 12 and 14, respectively, as shown in FIG. 1. Moreover, the hurdle members 16 and 18 are held by the sleeves so that they are separated from the sleeves upon sufficient impact by a swimmer using the apparatus 10.

Apparatus 10 functions as follows. When it is desired to have a swimmer practice his/her starts using apparatus 10, the apparatus is placed near the edge of swimming pool 55 on deck 57, as shown in FIG. 1A. The tank 44 of starting block assembly 20 is filled with water, as discussed previously, which causes the starting block assembly 20 to remain stationary during the training session. The starting platform 60 is adjusted to account for the individual characteristics of the swimming pool 55. In addition, the angular orientations of first elongate rods 22 and 24 and the second elongate rods 26 and 28 are adjusted, as discussed previously. Further, the locations of the first sleeves 46 and 48 along the length of the first elongate rods 22 and 24, respectively, and the location of the second sleeves 50 and 52 along the length of the second elongate rods 26 and 28, respectively, are adjusted, as described previously. Each of these adjustments is made taking into account the individual physical stature and swimming ability of the swimmer who is to use the apparatus 10.

After these adjustments have been made, the first hurdle member 16 is placed in the grooves located in first sleeves 46 and 48. Similarly, the second hurdle member 18 is positioned in the grooves is second sleeves 50 and 52. The apparatus is now ready for use by the swimmer.

The swimmer takes a starting position on platform 60. Upon a signal or command the swimmer dives into water 59 seeking to pass over first hurdle member 16 and beyond second hurdle member 18. If the swimmer fails in this attempt, he/she impacts one or more of the hurdle members causing the hurdle member or member to fall into the water. If a hurdle member falls into the water it is a simple matter to take the hurdle member out of the water and position it back on the appropriate sleeves.

Various other swim training exercises can be done using apparatus 10. For example, the second hurdle 18 can be placed in the optional first sleeves 45 and 47, with the positions of all the first sleeves along the length of the first elongate rods 22 and 24 being suitably adjusted. The swimmer then attempts to dive between the two hurdles without impacting either hurdle. Such an exercise is effective in allowing the swimmer to achieve more consistent race starts. Of course, both hurdles 16 and 18 can be placed in the second sleeves 49, 50, 51 and 52 or three or four hurdles can be placed in the grooves. In short, the apparatus 10 can be used in many different configurations to help swimmers achieve better race starts and, ultimately, reduced race times.

The apparatus 10 can be used very effectively for continuous training to improve the swimmer's starting technique. For example, the swimmer can use the apparatus 10 repeatedly, without danger of causing any harm to either the swimmer or the apparatus. In addition, if another swimmer wishes to train using apparatus 10, the apparatus can be adjusted as described above to take into account the stature and ability of a new swimmer. The adjustability, portability and flexibility of the present apparatus are important advantages in training many different swimmers at different locations.

While this invention has been described with respect to various specific examples and embodiments, it is to be understood that the invention is not limited thereto and that it can be variously practiced within the scope of the following claims.

What is claimed is:

1. An apparatus for training a swimmer to start a race in a swimming pool containing water, which apparatus comprises:

a first support assembly structured and adapted to be coupled to a deck of the swimming pool and to extend outwardly above the water in the swimming pool;

a first hurdle member adapted to be held at two spaced apart locations by the first support assembly above the water in the swimming pool, to be separated from the first support assembly by the force of a swimmer impacting the first hurdle member and to, thereafter, be positioned to be held at two spaced apart locations by the first support assembly;

a second support assembly joined to the first support assembly; and a second hurdle member adapted to be held by the second support assembly, the first hurdle member being located higher than the second hurdle member.

2. The apparatus of claim 1 wherein the second hurdle member is further adapted to be separated from the second support assembly by the force of a swimmer impacting the second hurdle member while the second support assembly remains intact and to, thereafter, be positioned to be held at two spaced apart locations by the intact second support assembly.

3. The apparatus of claim 1 wherein the second hurdle member is adapted to be held by the second support assembly at an elevation above the water in the swimming pool.

4. The apparatus of claim 1 wherein the first support assembly includes two spaced apart first elongate rods adapted to extend outwardly above the water in the swimming pool and two first sleeves, each of the first sleeves being located on a different one of the first rods and adapted to hold a portion of the first hurdle member.

5. The apparatus of claim 4 wherein each of the first sleeves is adjustable to be located at any one of a plurality of positions along the length of the first rod on which the first sleeve is located.

6. The apparatus of claim 5 wherein said first support assembly further includes a first sleeve adjustment assembly positioned so that both of the first sleeves are attached thereto and are adapted to be manually moved so that each of the first sleeves is located, at any given time, at substantially the same relative position along the length of the first rod on which the first sleeve is located.

7. The apparatus of claim 4 wherein each of the first sleeves includes a first groove sized and adapted to receive the portion of the first hurdle member, and each of the first grooves includes a hook portion or a loop portion of a hook/loop fastener combination and each of the portions of the first hurdle member received in the first grooves includes the other of the loop portion or the hook portion of the hook/loop fastener combination.

8. The apparatus of claim 1 wherein the second support assembly includes two spaced apart second elongate rods adapted to extend outwardly above the water in the swimming pool and two second sleeves, each of the second sleeves being located on a different one of the second rods and adapted to hold a portion of the second hurdle member.

9. The apparatus of claim 8 wherein each of the second sleeves is adjustable to be located at any one of a plurality of positions along the length of the second rod on which the second sleeve is located.

10. The apparatus of claim 9 wherein said second support assembly further includes a second sleeve adjustment assembly positioned so that both of the second sleeves are attached thereto and adapted to be manually moved so that each of the second sleeves is located, at any given time, at substantially the same relative position along the length of the second rod on which the second sleeve is located.

11. The apparatus of claim 8 wherein each of the second sleeves includes a second groove sized and adapted to receive the portion of the second hurdle member, and each of the second grooves includes a hook portion or a loop portion of a hook/loop fastener combination and each of the portions of the second hurdle member received in the second grooves includes the other of the loop portion or the hook portion of the hook/loop fastener combination.

12. The apparatus of claim 1 which further comprises a portable block assembly including an adjustable starting platform on which the swimmer ready to use the apparatus starts.

13. The apparatus of claim 1 wherein the first support assembly is adjustable to hold the first hurdle member at any one of a plurality of different positions.

14. An apparatus for training a swimmer to start a race in a swimming pool containing water, which apparatus comprises:

a first support assembly structured and adapted to be coupled to a deck of the swimming pool and to extend outwardly above the water in the swimming pool;

a first hurdle member adapted to be held by the first support assembly above the water in the swimming pool;

a second support assembly joined to the first support assembly structured and adapted to extend outwardly above the water in the swimming pool; and a second hurdle member adapted to be held by the second support assembly above the water in the swimming pool, to be separated from the second support assembly by the force of a swimmer impacting the second hurdle member and to, thereaf ter, be positioned to be held by the second support assembly, the first hurdle member being located higher than the second hurdle member.

15. The apparatus of claim 14 wherein the second hurdle member is positioned relative to the first hurdle member to extend further away from a swimmer ready to use the apparatus.

16. The apparatus of claim 14 wherein the first support assembly is adjustable to hold the first hurdle member at any one of a plurality of different positions, and the second support assembly is adjustable to hold the second hurdle member at any one of a plurality of different positions.

17. The apparatus of claim 14 wherein the first support assembly is adjustable to extend away from a swimmer ready to use the apparatus at any one of a plurality of angles relative to the water in the swimming pool, and the second support assembly is adjustable to extend away from a swimmer ready to use the apparatus at any one of a plurality of angles relative to the water in the swimming pool.

18. The apparatus of claim 14 wherein the first hurdle member includes two rigid, spaced apart first end segments each coupled to a soft, first middle segment.

19. The apparatus of claim 14 wherein the second hurdle member includes two rigid, spaced apart second end segments each coupled to a soft, second middle segment.

20. An apparatus for training a swimmer to start a race in a swimming pool containing water, which apparatus comprises:

a first support assembly;

a first hurdle member adapted to be held at two spaced adart locations by the first support assembly above the water in the swimming pool;

a second support assembly joined to the first support assembly; and a second hurdle member adapted to be held at two spaced apart locations by the second support assembly at an elevation above the water in the swimming pool, the first hurdle member being located higher than the second hurdle member.

* * * * *